United States Patent [19]

Elrod

[11] 3,971,589

[45] July 27, 1976

[54] RETRACTABLE AUTOMOBILE TRUNK LID TIE DOWN

[76] Inventor: Donald L. Elrod, 1801 Butler Road, Willis, Mich. 48191

[22] Filed: Feb. 19, 1974

[21] Appl. No.: 443,254

[52] U.S. Cl. ..... 296/76; 292/262

[51] Int. Cl.[2] ..... B62D 25/10

[58] Field of Search ..... 296/76; 292/262, 288; 242/107.6; 224/42.03 R, 42.4

[56] References Cited

UNITED STATES PATENTS

| | | | |
|---|---|---|---|
| 2,474,899 | 7/1949 | Hutt | 242/107.6 X |
| 2,908,522 | 10/1959 | Glave | 292/288 |
| 2,916,902 | 12/1959 | Wamsley | 296/76 |
| 2,919,946 | 1/1960 | Miener | 224/42.03 X |
| 3,011,818 | 12/1961 | Matthiessen | 296/76 X |

*Primary Examiner*—Albert J. Makay
*Assistant Examiner*—Donald W. Underwood
*Attorney, Agent, or Firm*—Edward M. Apple

[57] ABSTRACT

A retractable cable or cord, wound on a spring biased reel, which is removably secured to the inside of the hinged trunk lid. The cable has anchor means for attaching its free end to a fixed part of the inside of the trunk proper.

6 Claims, 6 Drawing Figures

FIG. 1
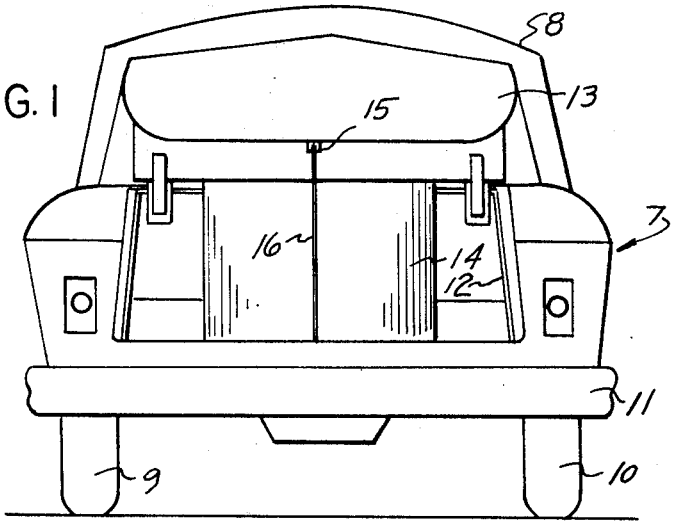
FIG. 3
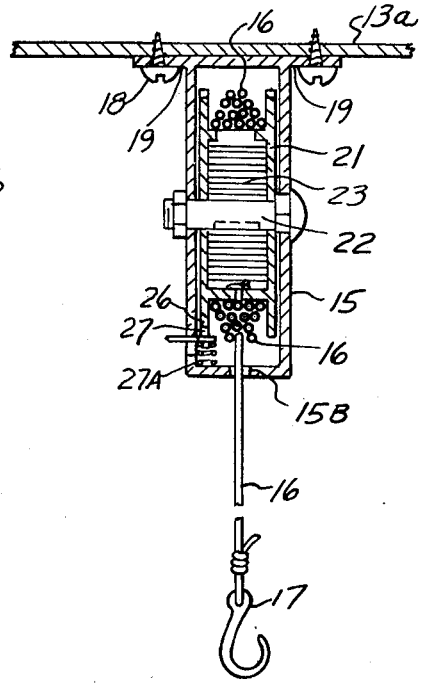
FIG. 2
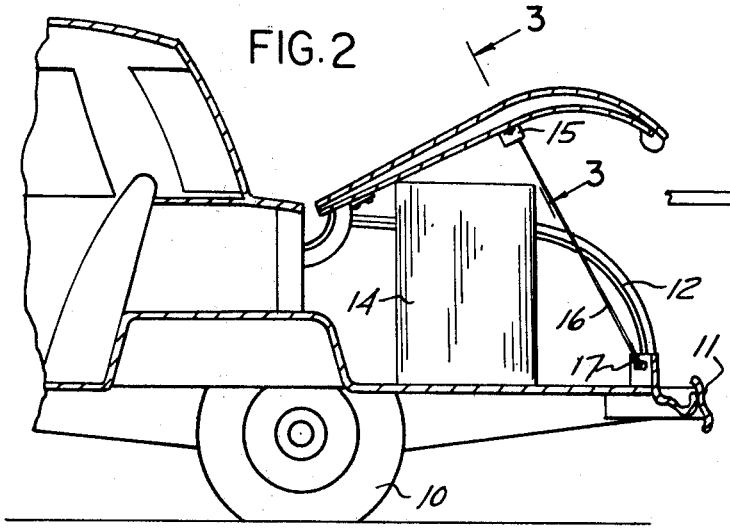
FIG. 4
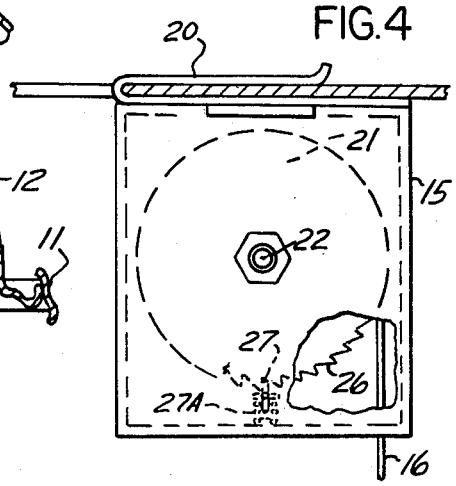
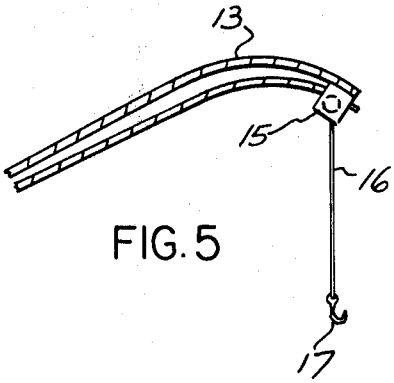
FIG. 5
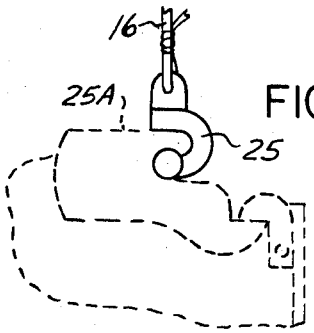
FIG. 6

RETRACTABLE AUTOMOBILE TRUNK LID TIE DOWN

This invention relates to motor vehicle accessories and has particular reference to a device for securing the trunk lid in various positions of openness, to accomodate objects too large to permit the trunk to be closed.

I am aware of the fact that others have disclosed devices for accomplishing the same results, but the devices now known to the public leave much to be desired. The known devices are invariably complicated and expensive to manufacture, or rely on levers, cams, expansion springs, elastic cords and even plain rope to do the job. Some of the known devices require comparatively long lengths of rope, strap or cable, with multiple anchor points to effect the results, whereas others employ rigid struts and counter acting flexible means to secure the trunk lid in place. all are cumbersome and are usually not at hand when it is desired to use them.

It is therefore an object of this invention to obviate the foregoing difficulties and to generally improve the art and to provide a simple device, which is economical to manufacture and install, and one which will outlive the vehicle and may readily be removed from one car and placed on another car without special tools or equipment, or it may be attached to the underside of the trunk lie, to remain there unseen and out of the lid, but always available for instant use when it is needed.

Another object of the invention is to provide a tie down device of the character indicated, which is provided with a retractable spool or reel, rotatably mounted in a housing which may be removably secured to the reinforcing structure of the trunk lid, without weakening or modifying the structure.

Another object of the invention is to provide a device of the character indicated, which may be combined with the trunk lock mechanism to hold the lid in various required positions.

Another object of the invention is to provide a latch hook for the free end of the cable, which may be received in the lock mechanism of an electric lock release, such as disclosed in U.S. Pat. No. 3,504,511.

Another object of the invention is to provide a device of the character indicated, which is formed with a spring clip, whereby it may be quickly attached to and removed from the trunk lid of the vehicle.

The foregoing and other objects and advantages of the invention will become more apparent as the description proceeds, reference being made from time to time to the accompanying drawing, forming part of the within disclosure, in which drawing:

FIG. 1 is a rear elevational view of a motor vehicle, with a large box in the trunk and the trunk lid partially open and controlled by the invention device.

FIG. 2, is a central vertical section taken through the vehicle shown in FIG. 1.

FIG. 3 is an enlarged section taken on the line 3—3 of FIG. 2.

FIG. 4 is an enlarged detail, with parts broken away and parts in section, showing a modified form of the invention.

FIG. 5 is a detail, in section, showing the reel housing and one form of hook at the end of the cable. In this view the reel housing is an integral part of the lid locking mechanism housing.

FIG. 6 is an enlarged detail, with parts broken away, showing a modified form of hook (shown in solid lines) for use with an electric release type of trunk lock mechanism (shown in broken lines).

Referring now more particularly to the drawing it will be understood that in the embodiment herein disclosed the reference character 7, indicates in general, a motor vehicle having a top 8, wheels 9 and 10, a bumper 11, a rear trunk 12 with a hinge lid 13, which is controlled in partly open position, to accomodate a large object 14, by the invention device, which consists briefly of a reel housing 15, a cord or cable 16 and an anchor hooks 17, 25.

The housing 15 may be secured to the underside of the lid frameword 13A by metal screws 18, which extend through ears 19, formed integrally with the housing 15, (FIG. 3) or it may be secured to a portion of the lid frame work 13A by means of a spring clip 20 (FIG. 4).

Inside the housing 15 (FIGS. 3 & 4) is a rotatable reel 21, which rotates on a spindle 22, which has its ends supported by the housing 15. The reel 21 is provided with a flat coiled spring 23, one end of which is attached to the reel 21 and the other end of which is attached to a cable or cord 16, which is wound on the flat spring 23 and extends through an opening 15B in the housing 15 and carries at its free end a conventional hook 17 (FIGS. 3 & 5), or a special hook 25 (FIG. 6) for use with an electric release locking mechanism 25A shown in broken lines (FIG. 6).

The conventional hook 17 may be secured to any fixed part of the trunk proper, whereas the special hook 25 is intended to be secured to the lock mechanism 25A of an electric release lock, which is located in the trunk.

One edge of the reel 21 may be provided with ratchet teeth 26, which are engaged by a spring biased dog 27. The reel of 21 may be rotated in one direction by pulling the cable 16, during which rotation the teeth 26 ride over the dog 27 but the dog 27 prevents the rotation of the reel 21 in the opposite direction. The dog 27 may be manually released from the teeth 26 by pressing downwardly to compress the spring 27A. The reel 21 is then free to recoil the cable or cord 16 under the tension of the flat spring 23.

The trunk lid 13 is generally provided with conventional expansion springs (not shown) which cause the lid to spring open when the lock is released, or when the hook 17 or 25 is released from the trunk. Upon release of the hook 17 or 25 the cord or cable 16 is retracted into the housing 15 out of the way for storage and future use and the trunk may then be unlocked and closed as in conventional practice. As long as the hook 17 or 25 remains anchored and the cable 16 taut the lid 13 will remain in its adjusted open position and will not jiggle or vibrate as the taut cable under the tension of spring 23 will hold the lid 13 firmly against the large object 14.

It will be understood that in some applications the teeth 26 and dog 27 may be dispensed with, as the tension in the coiled flat spring 23 will always recoil the cable 16 on the reel to hold the lid 13 against the object 14. It will also be understood that the normal tension in the spring 23 must be sufficient to overcome the tension in the conventional hinge springs (not shown) between the vehicle body and the lid. It will further be understood that the reel housing 15 and the cable 16 and hook 17 may be reversed from the positions shown in FIGS. 1–5. In other words the reel and housing 15 may be mounted in the trunk and the hook 17 may be anchored to the lid 13 with equal facility. It will also be understood that the housing 15 may be an integral part of the trunk lock mechanism housing.

It is believed that the operation of the device is obvious from the foregoing description.

Having described my invention what I claim and desire to secure by Letters Patent is:

1. The combination with a vehicle, having a trunk, a hinged lid, and an electric release trunk locking mechanism, of a tie down cable retractably secured to a spring biased, rachet controlled, rotatable member, with a support element for said rotatable member secured to the underside of said lid, said cable having at it's free end an anchor element suitable for attachment to an element of said trunk locking mechanism, the anchor element comprises an anchor hook having an enlarged terminal end to be recieved in a recess formed in the latch element of said electric release trunk lock mechanism.

2. The structure of claim 1, in which said support is provided with a spring clip to be received on a structural member of said lid.

3. The structure of claim 1, in which said rotatable member is spring biased to rotate in one direction and is provided with said rachet control means for preventing its rotation in the opposite direction, there being manually operable means for releasing said rachet means.

4. The structure of claim 1, in which the support element for said rotatable member also serves as a storage housing for said rotatable member and said cable when the said cable is fully rectracted on said rotatable member.

5. The structure of claim 1, in which said support element is portable and is provided with means for quick attachment to another object.

6. The structure of claim 3, in which said cable is removable from and retractable onto said rotatable member, and said rachet release means are operable, through openings formed in said support element.

* * * * *